US006525460B1

(12) United States Patent
Soules et al.

(10) Patent No.: US 6,525,460 B1
(45) Date of Patent: Feb. 25, 2003

(54) VERY HIGH COLOR RENDITION FLUORESCENT LAMPS

(75) Inventors: Thomas F. Soules, Richmond Heights, OH (US); Pak K. Yuet, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 244 days.

(21) Appl. No.: 09/650,825

(22) Filed: Aug. 30, 2000

(51) Int. Cl.[7] ..... H01J 1/62; H01J 63/04; H01J 61/44

(52) U.S. Cl. ..... 313/487; 313/485; 313/486; 252/301.6 P; 252/301.4 R

(58) Field of Search ..... 313/485, 486, 313/487; 252/301.6 P, 301.4 P, 301.4 R

(56) References Cited

U.S. PATENT DOCUMENTS

| | | | | |
|---|---|---|---|---|
| 3,287,586 A | * | 11/1966 | Bickford | 252/301.5 |
| 3,778,660 A | | 12/1973 | Kamiya et al. | |
| 4,296,353 A | | 10/1981 | Walter | |
| 4,307,321 A | | 12/1981 | Pappalardo et al. | |
| 4,357,559 A | | 11/1982 | Piper | |
| 4,384,237 A | | 5/1983 | Taubner et al. | |
| 4,403,171 A | | 9/1983 | Nakano et al. | |
| 4,475,064 A | | 10/1984 | Burgess | |
| 4,527,087 A | | 7/1985 | Taya et al. | |
| 4,602,188 A | | 7/1986 | de Hair et al. | |
| 4,638,214 A | | 1/1987 | Beers et al. | |
| 4,644,223 A | | 2/1987 | de Hair et al. | |
| 4,663,563 A | | 5/1987 | Taya et al. | |
| 4,705,986 A | | 11/1987 | Iwama et al. | |
| 4,733,126 A | | 3/1988 | Yamakawa et al. | |
| 4,751,426 A | | 6/1988 | Hoffman et al. | |
| 4,800,319 A | * | 1/1989 | Van Kemenade et al. | 252/301.4 R |
| 4,847,533 A | * | 7/1989 | Hoffman | 313/487 |
| 4,891,550 A | | 1/1990 | Northrop et al. | |
| 4,926,091 A | | 5/1990 | Verlijisdonk et al. | |
| 4,963,787 A | | 10/1990 | Verlijsdonk et al. | |
| 5,049,779 A | | 9/1991 | Itsuki et al. | |
| 5,113,118 A | | 5/1992 | Sigai et al. | |
| 5,151,215 A | | 9/1992 | Sigai | |
| 5,185,180 A | | 2/1993 | Kasenga et al. | |
| 5,188,763 A | | 2/1993 | Chenot et al. | |
| 5,223,341 A | | 6/1993 | Sigai | |
| 5,256,096 A | | 10/1993 | Lagos | |
| 5,289,081 A | | 2/1994 | Tamatani et al. | |
| 5,350,971 A | | 9/1994 | Jeong | |
| 5,358,734 A | | 10/1994 | Lenox et al. | |
| 5,417,886 A | | 5/1995 | Tateiwa et al. | |
| 5,441,774 A | | 8/1995 | Dutta et al. | |
| 5,714,836 A | | 2/1998 | Hunt et al. | |
| 5,731,659 A | | 3/1998 | Soules et al. | |
| 5,838,100 A | | 11/1998 | Jansma | |
| 5,917,291 A | | 6/1999 | Soules et al. | |
| 6,157,126 A | * | 12/2000 | Yano et al. | 313/485 |
| 6,242,857 B1 | * | 6/2001 | Hashimoto et al. | 252/301.4 H |
| 6,252,254 B1 | * | 6/2001 | Soules et al. | 257/100 |

FOREIGN PATENT DOCUMENTS

| | | | | |
|---|---|---|---|---|
| JP | 10021714 A | * | 1/1998 | H01J/61/35 |

* cited by examiner

*Primary Examiner*—Nimeshkumar D. Patel
*Assistant Examiner*—Sikha Roy
(74) *Attorney, Agent, or Firm*—Pearne & Gordon LLP

(57) ABSTRACT

A high color-rendering fluorescent lamp comprising a phosphor layer wherein the phosphors are selected such that the general color rendering index, $R_a$ is greater than 96 or 97 or 98 at color temperatures of 2700 K to 6600 K, and all the special color rendering indices are greater than 90 at color temperatures of 2900 K to 6500 K.

17 Claims, 1 Drawing Sheet

VERY HIGH COLOR RENDITION FLUORESCENT LAMPS

BACKGROUND OF THE INVENTION

The present invention relates generally to fluorescent lamps and more particularly to high color rendering fluorescent lamps.

Color rendition is a measure of the light reflected by a color sample under a given light source, compared to the light reflected by the same sample under a standard light source. Color rendition is calculated as disclosed in "Method of Measuring and Specifying Colour Rendering Properties of Light Sources, 2nd Edition", International Commission on Illumination, Publication CIE No. 13.2 (TC-3.2) 1974, the contents of which are hereby incorporated by reference. The differences in value, chroma and hue of the light reflected under the two sources are measured and summed, the square root of the sum is taken, multiplied by a constant, and subtracted from 100. This calculation is done for 14 different color standards. The color rendering index for each of these standards is designated $R_i$. The General Color Rendering Index, $R_a$, is defined as the average of the first eight indices, $R_1$–$R_5$. The constant has been chosen such that $R_a$ for a standard warm white fluorescent tube is approximately 50. It should be noted that an $R_a$ of 100 corresponds to a light source under which the color samples appear exactly as they would under a standard light source, such as an incandescent (black body) lamp or natural daylight.

In certain commercial and residential applications very high color rendition is desirable. Examples include cinema productions, grocery and clothing stores, photographic studios, areas where color comparisons are being made, museums, etc. Although standard fluorescent lamps have many advantages, such as providing diffuse uniform lighting, relatively high efficiency, and low heat generation, they are often inadequate for these applications, as they typically have color rendition indices of 50–85.

Some high color rendering phosphor blends have been developed for these applications. In the tri-phosphor systems used in conventional fluorescent lamps, the phosphors are typically chosen in order to provide three peak emissions, one red, one blue, and one green. The mixture of these three emissions generates the generally white light emitted from the lamp. To produce high color rendering phosphor blends, the phosphors are chosen in order to "fill in" the visible spectrum, i.e. provide emission at substantially all wavelengths across the visible spectrum. U.S. Pat. Nos. 3,778,660, 4,296,353, 4,602,188, 4,644,223, 4,705,986, 4,527,087, 4,891,550 and 5,350,971, the contents of which are incorporated herein by reference, all suggest various phosphor blends for increasing the color rendering properties of fluorescent lamps.

Specifically, U.S. Pat. No. 4,705,986 to Iwama et al. ("the '986 patent") discloses phosphor blends that yield color rendering indices of 98–99 at 5000 K correlated color temperature (CCT). However, in order to achieve such high indices with the blends disclosed in the '986 patent, it is necessary to utilize two separate phosphor layers.

U.S. Pat. No. 3,778,660 to Kamiya et al. ("the '660 patent") discloses phosphor blends that yield color rendering indices as high as 97, but cannot achieve color rendering indices higher than 97.

Also, it is difficult to get very high color rendering of saturated reds as measured by the color rendering index $R_9$. U.S. Pat. No. 4,527,087 to Taya et al. discloses phosphor blends which achieve a value of $R_a$ of 99 at 5200 K (CCT). However, the blends disclosed in that reference cannot achieve a value for $R_9$ greater than 97. High color rendition of certain other colors, such as vegetable green, flesh tones, etc. is also generally not achieved.

Also, the above patents disclose phosphor systems which achieve high color rendition for lamps with CCTs of greater than 5000 K. In North America and Europe, people often prefer lower color temperature lamps. The most popular fluorescent lamps are cool white (CCT=4100 K), white (CCT=3500 K) and warm white (CCT=3000 K). It is more difficult to achieve very high color rendition values at the lower color temperatures for which the reference sources are incandescent radiators rather than daylight.

Finally, some of the high color rendering phosphor blends which are on the market utilize 5 or 6 or more different phosphors. Blending such a large number of phosphors to hit a desired color and spectrum is difficult, and this needs to be done repeatedly because the properties of the phosphors may change from lot to lot.

There is a need to achieve higher color rendering than has been heretofore possible in fluorescent lamps. The fluorescent lamps of the present invention render all the CIE muted colors and all special colors so that they are virtually indistinguishable from their appearance under an incandescent or daylight source. The present invention provides lamps with color temperatures from 2700 K or 2900 K to 6500 K or 6600 K which achieve $R_a$ values of 98–99. All special color rendition indices are greater than 90, and in particular, the saturated red color rendition index, $R_9$ is greater than 97.

There is a further need to achieve these very high values of the color rendition indices with a minimal number, i.e. 3 to 4, phosphors in a blend.

There is a further need to achieve the very high color rendition by employing a filter to absorb radiation between 400 nm and 450 nm and thereby reduce the intensity of the mercury lines at 405 nm and 435 nm.

There is a further need to achieve the desired high color rendition by blending the phosphors in precise ratios thus producing a balanced spectrum. The amount of each phosphor is preferably adjusted so that the color rendition index is a maximum.

SUMMARY OF THE INVENTION

A mercury vapor discharge lamp is provided which comprises a glass envelope, means for providing a discharge, a discharge-sustaining fill of mercury and an inert gas sealed inside the envelope, and a phosphor-containing layer coated inside said glass envelope. The phosphor blend in the phosphor-containing layer is 40 to 80 weight percent of a first phosphor having an emission band with a maximum between 610 nm and 640 nm and having a half-value width of 10 nm to 100 nm, 0 to 20 weight percent of a second phosphor having an emission band with a maximum between 620 nm and 660 nm and having a half-value width of 1 nm to 30 nm, 8 to 50 weight percent of a third phosphor having an emission band with a maximum between 460 nm and 515 nm and having a half-value width of 50 nm to 120 nm, and 0 to 10 weight percent of a fourth phosphor having an emission band with a maximum between 530 nm and 560 nm and having a half-value width of 2 nm to 130 nm.

DETAILED DESCRIPTION OF THE PREFERRED EMBODIMENTS OF THE INVENTION

Figure 1:
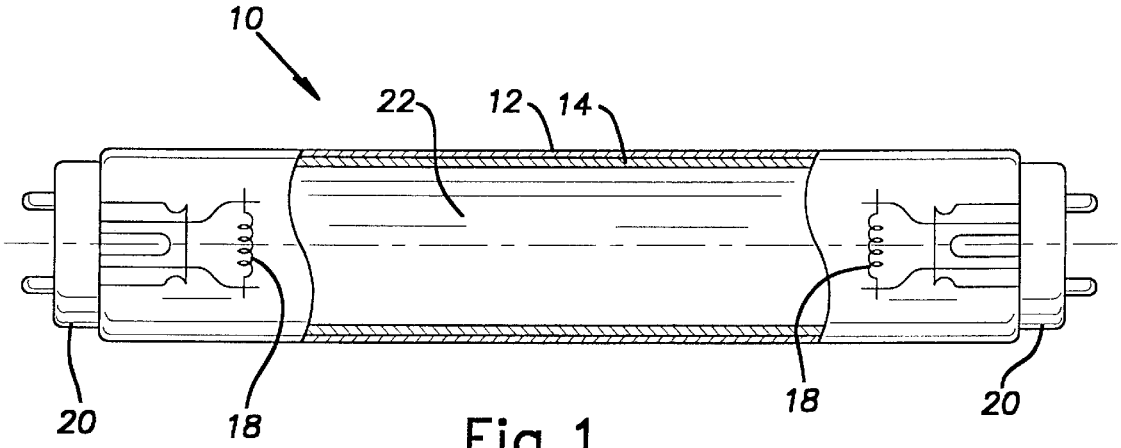
FIG. 1 shows diagrammatically, and partially in section, a fluorescent lamp according to the present invention.

As used herein, parts are parts by weight and percents are weight percents unless otherwise indicated or apparent. When a preferred range such as 5–25 is given, this means preferably at least 5 and, separately and independently, preferably not more than 25. Color temperatures are CCT.

FIG. 1 shows a representative low pressure mercury vapor discharge fluorescent lamp 10, which is generally well-known in the art. The fluorescent lamp 10 has a clear light-transmissive glass tube or envelope 12 which has a circular cross-section. The inner surface of the glass envelope is provided with a phosphor-containing layer 14 according to the present invention.

The lamp is hermetically sealed by bases 20 attached at both ends, and a pair of spaced electrode structures 18 (which are means for providing a discharge) are respectively mounted on the bases 20. A discharge-sustaining fill 22 of mercury and an inert gas is sealed inside the glass tube. The inert gas is typically argon or a mixture of argon and other noble gases at low pressure which, in combination with a small quantity of mercury, provide the low vapor pressure manner of operation.

The invented high color rendering phosphor-containing layer 14 is preferably utilized in a low pressure mercury vapor discharge lamp. It may be used in fluorescent lamps having electrodes as is known in the art, as well as in electrodeless fluorescent lamps as are known in the art, where the means for providing a discharge is a structure which provides high frequency electromagnetic energy radiation.

The phosphor-containing layer 14 is a single layer and contains a high color rendering blend of, for example, 3 to 4 phosphors. The phosphor-containing layer 14 also preferably contains a filter that filters 1 to 60% of the radiation emitted between 400 nm and 450 nm.

The specific phosphor mixtures will depend on the color temperature which is desired. At relatively low color temperatures, such as between 2700 K and 3200 K, the phosphor mixture will include a general broad band red-emitting phosphor, a general broad-band blue-green-emitting phosphor, and a narrow-band red emitting phosphor to provide a deep red "spike" to fit this region of the incandescent spectrum. As the color temperature increases to between 3200 K and 4200 K, a narrow-band green-emitting phosphor may be added to the mixture. As the color temperature increases further to above 5000 K, the reference spectrum changes to a daylight spectrum and the deep red "spike" is no longer needed, thus the narrow-band red-emitting phosphor and possibly the green-emitting phosphor are eliminated and replaced by a second broad-band blue-green phosphor.

Though the specific amounts of the phosphors used will depend upon the color temperature, the phosphor blend in layer 14 will generally comprise 40 to 50 to 60 to 70 to 77 to 78 to 80% (the amount increasing with decreasing CCT) broad-band red-emitting phosphor, 0 to 1 to 2 to 4 to 6 to 8 to 10 to 20% narrow-band red-emitting phosphor, 8 to 10 to 15 to 20 to 23 to 28 to 30 to 40 to 50% broad-band blue-green-emitting phosphors, and 0 to 1 to 2 to 5 to 6 to 8 to 10%, narrow-band-green emitting phosphor. The layer 14 also comprises 0 to 0.2 to 0.5 to 1 to 2 to 3 weights % (based on the total weight of the phosphors) of a pigment capable of absorbing radiation having a wavelength between 400 nm and 450 nm.

Suitable general broad-band red-emitting phosphors include those having an emission band with a maximum between 610 nm and 640 nm, more preferably between 620 nm and 635 nm, and having a half-value width of between 10 nm and 100 nm, more preferably 20 nm and 70 nm, more preferably between 30 nm and 60 nm. Specifically, suitable general broad-band red-emitting phosphors preferably include $(Gd,Ce)MgB_5O_{10}:Mn^{2+}$, more preferably $(Sr,Mg,Ca)_3(PO_4)_2:Sn^{2+}$.

Suitable narrow-band red-emitting phosphors include those having an emission band with a maximum between 620 nm and 660 nm, more preferably between 640 nm and 660 nm, and having a half-value width of between 1 nm and 30 nm, more preferably 5 nm and 25 nm. Specifically, suitable narrow-band red-emitting phosphors include $Y_2O_3S:Eu^{3+}$, more preferably $YVO_4:Eu^{3+}$, more preferably $3(MgO).(GeO_2).(MgF_2):Mn^{2+}$.

Suitable general broad-band blue-green-emitting phosphors include those having an emission band with a maximum between 460 nm and 515 nm, more preferably between 470 nm and 510 nm, more preferably between 470 nm and 500 nm and having a half-value width of between 50 nm and 120 nm, more preferably 60 nm and 100 nm. Specifically, suitable general broad-band blue-green-emitting phosphors include $Ca_5(PO_4)_3F:Sb^{3+}$, more preferably $(Ba,Ca)_5(PO_4)_3Cl:Eu^{2+}$.

Suitable narrow-band green-emitting phosphors include those having an emission band with a maximum between 530 nm and 560 nm, more preferably between 540 nm and 560 nm, and having a half-value width of between 2 nm and 130 nm, more preferably 2 nm and 100 nm. Specifically, suitable narrow-band green-emitting phosphors include $Zn_2SiO_4:Mn^{2+}$, $LaPO_4:Ce^{3+},Tb^{3+}$, $(Gd,Ce)\ MgB_5O_{10}:Tb^{3+}$, and $Y_3Al_5O_{12}:Ce^{3+}$.

Suitable pigments or filters include any of those known in the art that are capable of absorbing radiation generated between 400 nm and 450 nm. Such pigments include, for example, nickel titanate or praesodinium zirconate. The pigment is used in an amount effective to filter 1% to 60%, more preferably 10% to 50%, more preferably 20% to 40%, of the radiation generated in the 400 nm to 450 nm range.

Less preferably, the radiation may be filtered by coating the outside of the glass tube 12 with a polymeric film or cover. The film may include a pigment or dye capable of absorbing radiation in the desired range of 400 nm to 450 nm. For example, the pigment/filter or other suitable dyes can be incorporated as a filter into a plastic sleeve which is placed over or slid over the lamp and serves also as a shatter-resistant shield or cover. Such a cover has advantages, including protecting the lamp and making it shatter resistant, and also blocking undesired UV radiation. Such pigments or filters are more important at the lower color temperatures (2700–4200 K) where it is preferable to absorb 20–60% of the radiation in this 400–450 nm range. As the color temperature increases above 4200 K, less radiation (i.e. 0 or 1 or 3 to 20%) should be absorbed to achieve the desired $R_a$ greater than 98.

By use of the present invention, lamps can be provided having $R_a$ values greater than 96, more preferably greater than 97, more preferably greater than 98, at color temperatures of 2700 K to 2900 K, 2900 K to 3200 K, 3200 K to 4200 K, 4200 K to 5000 K, 5000 K to 6500 K or 6600 K and any combinations thereof. The $R_a$ values are generally not greater than 99.

The following Example further illustrates various aspects of the invention. All percentages are weight percent unless otherwise indicated.

| Color Temperature | Phosphors | Spectral Amount | Relative Wts. |
|---|---|---|---|
| 2900K | $(Sr,Mg,Ca)_3(PO_4)_2:Sn^{2+}$ | 0.766 | 0.77 |
| | $3(MgO).(GeO_2).(MgF_2):Mn^{2+}$ | 0.078 | 0.06 |
| | $(Ba,Ca)_5(PO_4)_3Cl:Eu^{2+}$ | 0.156 | 0.12 |
| | 50% 400–450 nm filtered | | |
| 3200K | $(Sr,Mg,Ca)_3(PO_4)_2:Sn^{2+}$ | 0.712 | 0.71 |
| | $3(MgO).(GeO_2).(MgF_2):Mn^{2+}$ | 0.061 | 0.05 |
| | $Y_3Al_5O_{12}:Ce^{3+}$ | 0.042 | 0.03 |
| | $(Ba,Ca)_5(PO_4)_3Cl:Eu^{2+}$ | 0.185 | 0.15 |
| | 50% 400–450 nm filtered | | |
| 6500K | $(Sr,Mg,Ca)_3(PO_4)_2:Sn^{2+}$ | 0.503 | 0.50 |
| | $Ca_5(PO_4)_3F:Sb^{3+}$ | 0.271 | 0.27 |
| | $(Ba,Ca)_5(PO_4)_3Cl:Eu^{2+}$ | 0.226 | 0.19 |
| | 15% 400–450 nm filtered | | |

The above-listed phosphor combinations yielded the following color rendition values for the Average Color Rendition Index ($R_a$), and the color rendition indices for Saturated Red ($R_9$), Saturated Yellow ($R_{10}$), Flesh Tone ($R_{13}$) and Vegetable Green ($R_{14}$):

| Color Temp. | $R_a$ | $R_9$ | $R_{10}$ | $R_{13}$ | $R_{14}$ |
|---|---|---|---|---|---|
| 2900K | 98 | 98 | 98 | 99 | 97 |
| 3200K | 99 | 99 | 98 | 99 | 97 |
| 6500K | 99 | 99 | 99 | 98 | 99 |

Although the preferred embodiments of the invention have been shown and described, it should be understood that various modifications may be resorted to without departing from the scope of the invention as disclosed and claimed herein.

| Color Temperature | Phosphors | Spectral Amount | Relative Wts. |
|---|---|---|---|
| 2900K | $(Sr,Mg,Ca)_3(PO_4)_2:Sn^{2+}$ | 0.766 | 0.77 |
| | $3(MgO).(GeO_2).(MgF_2):Mn^{2+}$ | 0.078 | 0.06 |
| | $(Ba,Ca)_5(PO_4)_3Cl:Eu^{2+}$ | 0.156 | 0.12 |
| | 50% 400–450 nm filtered | | |
| 3200K | $(Sr,Mg,Ca)_3(PO_4)_2:Sn^{2+}$ | 0.712 | 0.71 |
| | $3(MgO).(GeO_2).(MgF_2):Mn^{2+}$ | 0.061 | 0.05 |
| | $Y_3Al_5O_{12}:Ce^{3+}$ | 0.042 | 0.03 |
| | $(Ba,Ca)_5(PO_4)_3Cl:Eu^{2+}$ | 0.185 | 0.15 |
| | 50% 400–450 nm filtered | | |
| 6500K | $(Sr,Mg,Ca)_3(PO_4)_2:Sn^{2+}$ | 0.503 | 0.50 |
| | $Ca_5(PO_4)_3F:Sb^{3+}$ | 0.271 | 0.27 |
| | $(Ba,Ca)_5(PO_4)_3Cl:Eu^{2+}$ | 0.226 | 0.19 |
| | 15% 400–450 nm filtered | | |

The above-listed phosphor combinations yielded the following color rendition values for the Average Color Rendition Index ($R_a$), and the color rendition indices for Saturated Red ($R_9$), Saturated Yellow ($R_{10}$), Flesh Tone ($R_{13}$) and Vegetable Green ($R_{14}$):

| Color Temp. | $R_a$ | $R_9$ | $R_{10}$ | $R_{13}$ | $R_{14}$ |
|---|---|---|---|---|---|
| 2900K | 98 | 98 | 98 | 99 | 97 |
| 3200K | 99 | 99 | 98 | 99 | 97 |
| 6500K | 99 | 99 | 99 | 98 | 99 |

Although the preferred embodiments of the invention have been shown and described, it should be understood that various modifications may be resorted to without departing from the scope of the invention as disclosed and claimed herein.

What is claimed is:

1. A mercury vapor discharge lamp comprising a glass envelope, means for providing a discharge, a discharge-sustaining fill of mercury and an inert gas sealed inside said envelope, and a phosphor-containing layer coated inside said glass envelope, the phosphor blend in said phosphor-containing layer being 40 to 80 weight % of a first phosphor having an emission band with a maximum between 610 nm and 640 nm and having a half-value width of 10 nm to 100 nm, 0 to 20 weight % of a second phosphor having an emission band with a maximum between 620 nm and 660 nm and having a half-value width of 1 nm to 30 nm, 8 to 50 weight % of a third phosphor having an emission band with a maximum between 460 nm and 515 nm and having a half-value width of 50 nm to 120 nm, and 0 to 10 weight % of a fourth phosphor having an emission band with a maximum between 530 nm and 560 nm and having a half-value width of 2 nm to 130 nm, said lamp having an $R_a$ value greater than 96 and a color temperature between 2700 K and 6600 K.

2. A lamp according to claim 1, wherein said first phosphor is selected from the group consisting of (Gd,Ce) $MgB_5O_{10}:Mn^{2+}$ and $(Sr,Mg,Ca)_3(PO_4)_2:Sn^{2+}$.

3. A lamp according to claim 2, wherein said first phosphor is present in an amount of 50 to 78 weight % and is $(Sr,Mg,Ca)_3(PO_4)_2:Sn^{2+}$.

4. A lamp according to claim 1, wherein said second phosphor is selected from the group consisting of $Y_2O_3S:Eu^{3+}$, $YVO_4:Eu^{3+}$, and $3(MgO).(GeO_2).(MgF_2):Mn^{2+}$.

5. A lamp according to claim 4, wherein said second phosphor is present in an amount of 1 to 6 weight % and is $3(MgO).(Geo_2).(MgF_2):Mn^{2+}$.

6. A lamp according to claim 1, wherein said third phosphor is selected from the group consisting of $Ca_5(PO_4)_3F:Sb^{3+}$ and $(Ba,Ca)_5(PO_4)_3Cl:Eu^{2+}$.

7. A lamp according to claim 6, wherein said third phosphor is present in an amount of 15 to 23 weight % and is $(Ba,Ca)_5(PO_4)_3Cl:Eu^{2+}$.

8. A lamp according to claim 1, wherein said fourth phosphor is selected from the group consisting of $Zn_2SiO_4:Mn_{2+}$, $LaPO_4:Ce^{3+},Tb^{3+}$, $(Gd,Ce)MgB_5O_{10}:Tb^{3+}$, and $Y_3Al_5O_{10}:Ce^{3+}$.

9. A lamp according to claim 8, wherein said fourth phosphor is present in an amount of 1 to 5 weight % and is $Y_3Al_5O_{12}:Ce^{3+}$.

10. A lamp according to claim 1, said lamp further comprising means effective to filter 1 to 60% of the radiation generated in the 400–450 nm range.

11. A lamp according to claim 10, wherein said means to filter is 0.2 to 3 weight percent (based on the total weight of the phosphors) pigment incorporated in said phosphor-containing layer, said pigment being capable of absorbing radiation having a wavelength between 400 nm and 450 nm.

12. A lamp according to claim 10, wherein said means to filter is a cover over the lamp, said cover utilizing pigment as a filter, said pigment being capable of absorbing radiation having a wavelength between 400 nm and 450 nm.

13. A lamp according to claim 10, wherein said means to filter utilizes pigment selected from the group consisting of nickel titanate and praesodinium zirconate.

14. A lamp according to claim 1, wherein said first phosphor is present in an amount of 50 to 80 weight % and is $(Sr,Mg,Ca)_3(PO_4)_2:Sn^{2+}$, said second phosphor is present in an amount of 2 to 8 weight % and is $3(MgO).(GeO_2).(MgF_2):Mn^{2+}$, and said third phosphor is present in an amount of 8 to 23 weight % and is $(Ba,Ca)_5(PO_4)_3Cl:Eu^{2+}$.

15. A lamp according to claim 1, said lamp having an $R_a$ value greater than 97 and a color temperature between 2700 K and 6600 K.

16. A lamp according to claim 1, said lamp having an $R_a$ value greater than 97 and a color temperature between 2700 K and 4200 K.

17. A lamp according to claim 1, said lamp having an $R_a$ value greater than 98 and a color temperature between 2700 K and 4200 K.

* * * * *